US006390315B1

(12) United States Patent
Giddings et al.

(10) Patent No.: US 6,390,315 B1
(45) Date of Patent: May 21, 2002

(54) RETROFITTABLE CAP

(76) Inventors: Sherrie L. Giddings; Daniel K. Campbell, both of 72 Inverness Street, Stratford, Ontario (CA), N5A 1G3

( * ) Notice: Subject to any disclaimer, the term of this patent is extended or adjusted under 35 U.S.C. 154(b) by 0 days.

(21) Appl. No.: 09/607,462

(22) Filed: Jun. 30, 2000

(51) Int. Cl.[7] ..... B65D 47/08

(52) U.S. Cl. ..... 215/235; 215/319; 220/287; 220/845; 220/849

(58) Field of Search ..... 215/235, 237, 215/306, 319, 329, 386, 400, 228; 220/259, 845, 847, 837, 375, 287, 849; 222/556

(56) References Cited

U.S. PATENT DOCUMENTS

| | | | | | |
|---|---|---|---|---|---|
| 3,185,332 | A | | 5/1965 | Greenstein | |
| 3,741,447 | A | * | 6/1973 | Miles et al. | 215/235 |
| 3,850,341 | A | * | 11/1974 | Bart | 215/319 |
| 3,933,271 | A | * | 1/1976 | McGhie | |
| 4,202,456 | A | * | 5/1980 | Silber | |
| D258,496 | S | | 3/1981 | Ludwig, Jr. et al. | |
| 4,869,389 | A | | 9/1989 | Cerrone, Jr. | |
| 4,898,298 | A | | 2/1990 | Norris | |
| 4,919,288 | A | | 4/1990 | Monti | |
| 5,125,525 | A | | 6/1992 | Tucker | |
| 5,305,900 | A | * | 4/1994 | Maguire et al. | |
| 5,582,333 | A | * | 12/1996 | Bennett | 222/556 |
| 5,944,207 | A | * | 8/1999 | Reidenbach | 215/237 |
| 6,082,568 | A | * | 7/2000 | Flanagan | 215/235 |
| 6,112,452 | A | * | 9/2000 | Campbell | 215/319 |

* cited by examiner

*Primary Examiner*—Nathan J. Newhouse

(57) ABSTRACT

A retrofittable cap for re-sealing bottles. The retrofittable cap includes a tubular member. The tubular member has a top edge, a bottom edge, an outer surface and an inner surface. The inner surface has a shoulder thereon, which is generally positioned between the top and bottom edges. The shoulder divides an upper portion from a lower portion. The lower portion has a diameter greater than a diameter of the upper portion. A cover portion is hingedly coupled to the top edge of the tubular member. The cover portion is adapted to releasably engage the top edge.

7 Claims, 2 Drawing Sheets

RETROFITTABLE CAP

BACKGROUND OF THE INVENTION

1. Field of the Invention

The present invention relates to cap devices and more particularly pertains to a new retrofittable cap for re-sealing bottles.

2. Description of the Prior Art

The use of cap devices is known in the prior art. More specifically, cap devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,919,288; 3,185,332; 4,869,389; 5,125,525; 4,898,298; and U.S. Des. Pat. No. 258,496.

While these devices fulfill their respective, particular objectives and requirements, the aforementioned patents do not disclose a new retrofittable cap. The inventive device includes a tubular member. The tubular member has a top edge, a bottom edge, an outer surface and an inner surface. The inner surface has a shoulder thereon, which is generally positioned between the top and bottom edges. The shoulder divides an upper portion from a lower portion. The lower portion has a diameter greater than a diameter of the upper portion. A cover portion is hingedly coupled to the top edge of the tubular member. The cover portion is adapted to releasably engage the top edge.

In these respects, the retrofittable cap according to the present invention substantially departs from the conventional concepts and designs of the prior art, and in so doing provides an apparatus primarily developed for the purpose of re-sealing bottles.

SUMMARY OF THE INVENTION

In view of the foregoing disadvantages inherent in the known types of cap devices now present in the prior art, the present invention provides a new retrofittable cap construction wherein the same can be utilized for re-sealing bottles.

The general purpose of the present invention, which will be described subsequently in greater detail, is to provide a new retrofittable cap apparatus and method which has many of the advantages of the cap devices mentioned heretofore and many novel features that result in a new retrofittable cap which is not anticipated, rendered obvious, suggested, or even implied by any of the prior art cap devices, either alone or in any combination thereof.

To attain this, the present invention generally comprises a tubular member. The tubular member has a top edge, a bottom edge, an outer surface and an inner surface. The inner surface has a shoulder thereon, which is generally positioned between the top and bottom edges. The shoulder divides an upper portion from a lower portion. The lower portion has a diameter greater than a diameter of the upper portion. A cover portion is hingedly coupled to the top edge of the tubular member. The cover portion is adapted to releasably engage the top edge.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new retrofittable cap apparatus and method which has many of the advantages of the cap devices mentioned heretofore and many novel features that result in a new retrofittable cap which is not anticipated, rendered obvious, suggested, or even implied by any of the prior art cap devices, either alone or in any combination thereof.

It is another object of the present invention to provide a new retrofittable cap which may be easily and efficiently manufactured and marketed.

It is a further object of the present invention to provide a new retrofittable cap which is of a durable and reliable construction.

An even further object of the present invention is to provide a new retrofittable cap which is susceptible of a low cost of manufacture with regard to both materials and labor, and which accordingly is then susceptible of low prices of sale to the consuming public, thereby making such retrofittable cap economically available to the buying public.

Still yet another object of the present invention is to provide a new retrofittable cap which provides in the apparatuses and methods of the prior art some of the advantages thereof, while simultaneously overcoming some of the disadvantages normally associated therewith.

Still another object of the present invention is to provide a new retrofittable cap for re-sealing bottles.

Yet another object of the present invention is to provide a new retrofittable cap which includes a tubular member. The tubular member has a top edge, a bottom edge, an outer surface and an inner surface. The inner surface has a shoulder thereon, which is generally positioned between the top and bottom edges. The shoulder divides an upper portion from a lower portion. The lower portion has a diameter greater than a diameter of the upper portion. A cover portion is hingedly coupled to the top edge of the tubular member. The cover portion is adapted to releasably engage the top edge.

Still yet another object of the present invention is to provide a new retrofittable cap that is retrofittable to existing bottles.

Even still another object of the present invention is to provide a new retrofittable cap that has the ability to fit multiple sized bottles.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
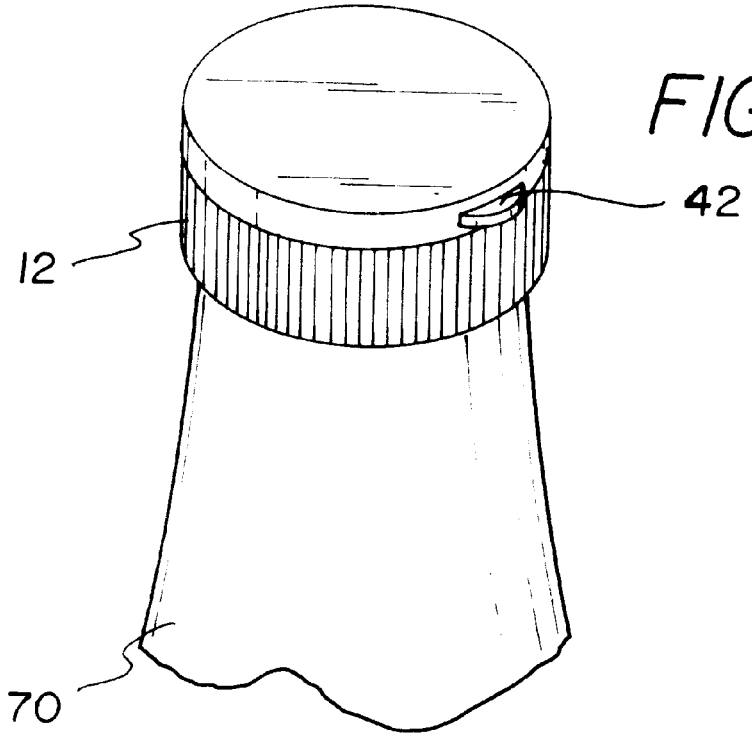
FIG. 1 is a schematic perspective view of a new retrofittable cap according to the present invention.
Figure 2:
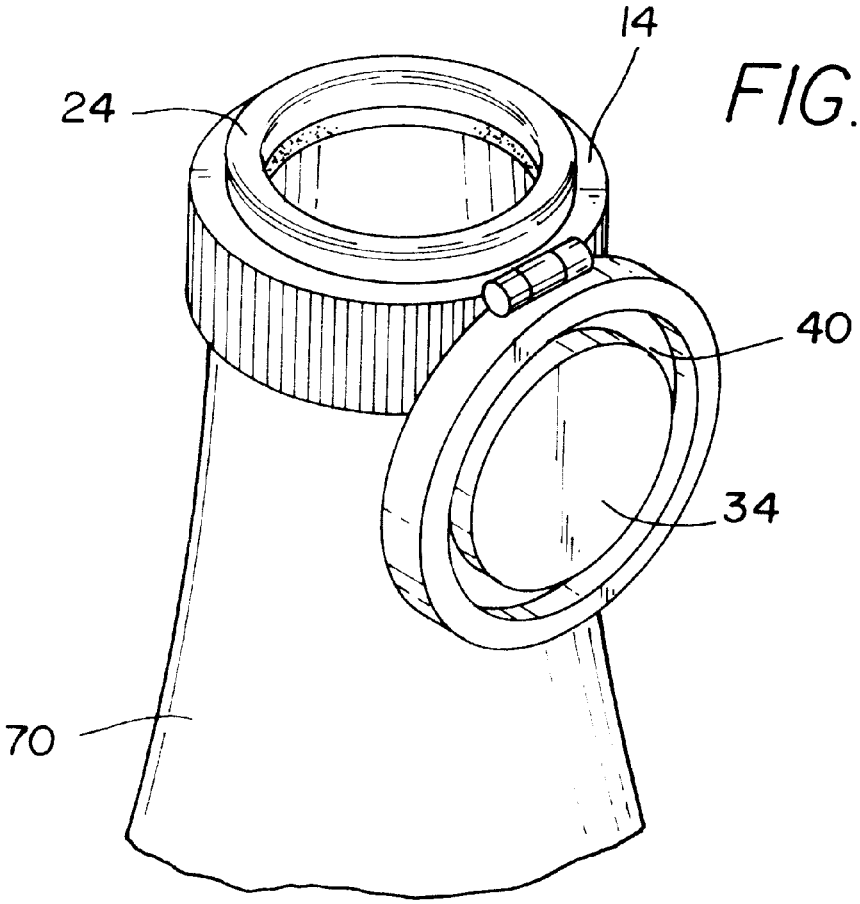
FIG. 2 is a schematic perspective view of the present invention.
Figure 3:
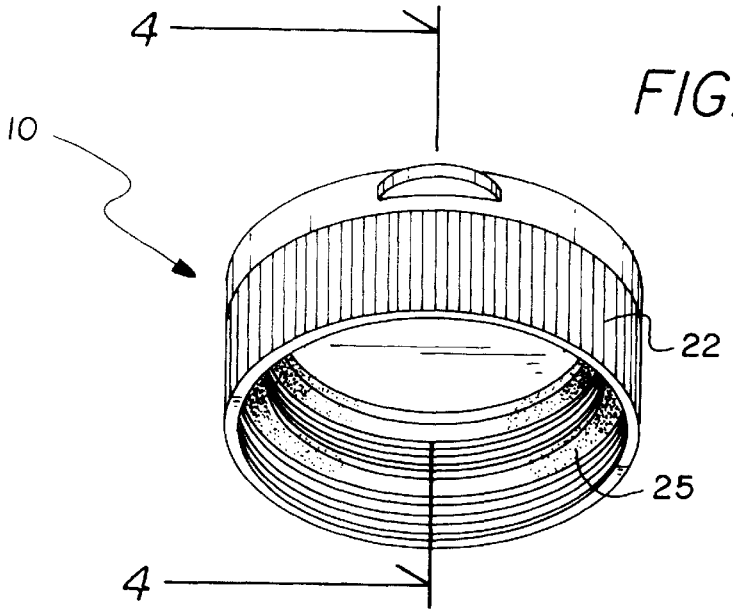
FIG. 3 is a schematic bottom perspective view of the present invention.
Figure 4:
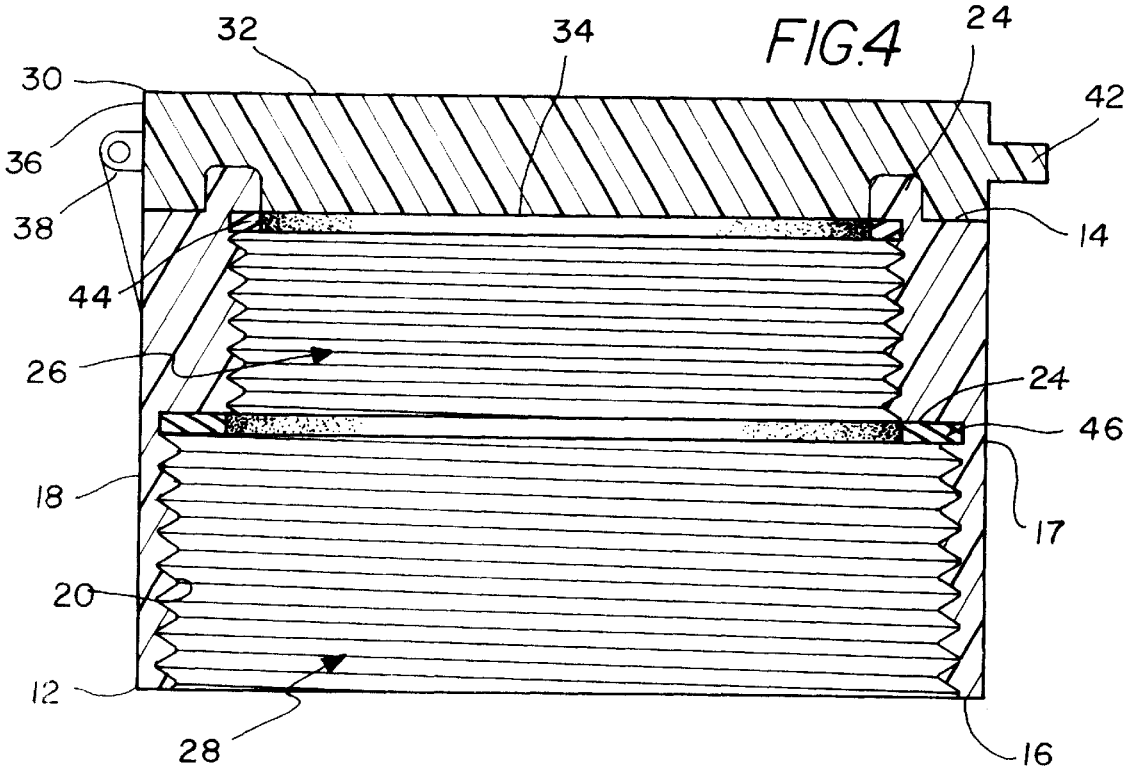
FIG. 4 is a schematic side cross-sectional view taken along line 4—4 of the present invention.

With reference now to the drawings, and in particular to FIGS. 1 through 4 thereof, a new retrofittable cap embodying the principles and concepts of the present invention and generally designated by the reference numeral 10 will be described.

As best illustrated in FIGS. 1 through 4, the retrofittable cap 10 generally comprises a tubular member 12. The tubular member 12 has a top edge 14, a bottom edge 16. A peripheral wall 17 of the tubular member has an outer surface 18 and an inner surface 20. The outer surface 18 has a plurality of grooves 22 therein. The grooves 22 generally extend between the top 14 and bottom 16 edges. An annular flange 24 extends upwardly from the top edge 14. The flange 24 is positioned along a juncture of the inner surface 20 and the top edge 16. The inner surface 20 has a shoulder 24 thereon. The shoulder 25 is generally positioned between the top 14 and bottom 16 edges. The shoulder 25 divides an upper portion 26 from a lower portion 28. The lower portion 28 has a diameter greater than a diameter of the upper portion 26. The different sized portions allow for accommodating different sized bottles. The inner surface 20 is threaded. The threads of the top portion 26 have a different size than the threads of the bottom portion 28 so that the tubular member 12 my couple to different types of thread on bottles 70.

A cover portion 30 has a top surface 32, a bottom surface 34 and a peripheral edge 36 extending therebetween. A hinging means 38 hingedly couples the peripheral edge 36 of the cover portion to the peripheral wall 17 such that the bottom surface 34 may be abutted against the top edge 14 of the tubular member 12. The bottom surface 34 has an annular channel 40 therein. The annular channel 40 is positioned to releasably engage the annular flange 24.

A protruding member 42 is integrally coupled to and extends away from the peripheral edge 36 of the cover portion 30. The protruding member 42 is positioned generally opposite of the hinging means 38.

A pair of sealing members 44, 46 is each securely attached to the inner surface 20 of the tubular member 12. A first of the sealing members 44 is positioned against the flange 24. A second of the sealing members 46 is positioned against the shoulder 25. The sealing members 44, 44 are preferably elastomeric washers.

Ideally, all components of the device 10 are comprised of an elastomeric material which allows for greater variation of different sized bottles.

In use, when a wine bottle 70, pop bottle, or other similar container is opened, the top may often times not be positioned over the opening. The device 10 is placeable over different sized bottles and will accommodate different sized threads. A user need only lift open the cover portion 30 to gain access to the contents of the bottle.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A cap device for removably capping a bottle, said device comprising:

a tubular member, said tubular member having a top edge, a bottom edge, and a peripheral wall extending between the top and bottom edge has an outer surface and an inner surface, said inner surface having a shoulder thereon, said shoulder being generally positioned between said top and bottom edges, said shoulder divides an upper portion from a lower portion, said lower portion having a diameter greater than a diameter of said upper portion, an annular flange extending upwardly from said top edge, said flange being positioned along a juncture of said inner surface and said top edge;

a cover portion, said cover portion being hingedly coupled to said top edge of said tubular member, said cover portion being adapted to releasably engage said top edge; and a pair of sealing members, each of said sealing members being securely attached to said inner surface of said tubular member, a first of said sealing members being positioned against said flange, a second of said sealing members being positioned against said shoulder.

2. The cap device as in claim 1, wherein said outer surface of said tubular member has a plurality of grooves therein, said grooves generally extending between said top and bottom edges.

3. The cap device as in claim 2, wherein said inner surface of said tubular member is threaded, said threads of said top portion having a different size than said threads of said bottom portion.

4. The cap device as in claim 1, wherein said cover portion has a top surface, a bottom surface and a peripheral edge extending therebetween, a hinging means hingedly couples said peripheral edge of said cover portion to said peripheral wall, said bottom surface having an annular channel therein, said annular channel being positioned to releasably engage said annular flange.

5. The cap device as in claim 4, further comprising a protruding member being integrally coupled to and extending away from said peripheral edge of said cover portion.

6. A cap device for removably capping a bottle, said device comprising:

a tubular member, said tubular member having a top edge, a bottom edge, and a peripheral wall extending between the top and bottom edge has an outer surface and an inner surface, said inner surface having a shoulder thereon, said shoulder being generally positioned between said top and bottom edges, said shoulder divides an upper portion from a lower portion, said lower portion having a diameter greater than a diameter of said upper portion, an annular flange extending upwardly from said top edge, said flange being positioned along a juncture of said inner surface and said top edge;

a cover portion being hingedly coupled to said top edge of said tubular member, said cover portion being adapted to releasably engage said top edge, said cover portion having a top surface, a bottom surface and a peripheral edge extending therebetween, a hinging means hingedly couples said peripheral edge of said cover portion to said peripheral wall, said bottom surface having an annular channel therein, said annular channel being positioned to releasably engage said annular flange; and a pair of sealing members, each of said sealing members being securely attached to said inner surface of said tubular member, a first of said sealing members being positioned against said flange, a second of said sealing members being positioned against said shoulder.

7. A cap device for removably capping a bottle, said device comprising:

a tubular member, said tubular member having a top edge, a bottom edge, and a peripheral wall extending between the top and bottom edge has an outer surface and an inner surface, said outer surface having a plurality of grooves therein, said grooves generally extending between said top and bottom edges, an annular flange extending upwardly from said top edge, said flange being positioned along a juncture of said inner surface and said top edge, said inner surface having a shoulder thereon, said shoulder being generally positioned between said top and bottom edges, said shoulder divides an upper portion from a lower portion, said lower portion having a diameter greater than a diameter of said upper portion, said inner surface being threaded, said threads of said top portion having a different size than said threads of said bottom portion;

a cover portion, said cover portion having a top surface, a bottom surface and a peripheral edge extending therebetween, a hinging means hingedly couples said peripheral edge of said cover portion to said peripheral wall such that said bottom surface may be abutted against said top edge of said tubular member, said bottom surface having an annular channel therein, said annular channel being positioned to releasably engage said annular flange;

a protruding member, said protruding member being integrally coupled to and extending away from said peripheral edge of said cover portion, said protruding member being positioned generally opposite of said hinging means; and a pair of sealing members, each of said sealing members being securely attached to said inner surface of said tubular member, a first of said sealing members being positioned against said flange, a second of said sealing members being positioned against said shoulder.

* * * * *